US005685357A

United States Patent [19]

Kato et al.

[11] Patent Number: 5,685,357

[45] Date of Patent: Nov. 11, 1997

[54] PROCESS FOR PRODUCING SHAPED PARTS OF METALS

[75] Inventors: Masashi Kato, Hiroshima; Kazuo Kitamura, Tokyo; Shinichi Okimoto, Hiroshima, all of Japan

[73] Assignee: The Japan Steel Works, Ltd., Tokyo, Japan

[21] Appl. No.: 427,194

[22] Filed: Apr. 24, 1995

[30] Foreign Application Priority Data

| | | | |
|---|---|---|---|
| Apr. 28, 1994 | [JP] | Japan | 6-111885 |
| May 17, 1994 | [JP] | Japan | 6-125862 |
| Mar. 10, 1995 | [JP] | Japan | 7-078462 |

[51] Int. Cl.[6] ..... B22D 17/00; B22D 25/00

[52] U.S. Cl. ..... 164/113; 164/900

[58] Field of Search ..... 164/113, 900, 164/303

[56] References Cited

U.S. PATENT DOCUMENTS

| | | | |
|---|---|---|---|
| 4,694,881 | 9/1987 | Busk | 164/113 |
| 4,694,882 | 9/1987 | Busk | 164/113 |
| 5,040,589 | 8/1991 | Bradley et al. | 164/113 |

FOREIGN PATENT DOCUMENTS

| | | | |
|---|---|---|---|
| 3639737 | 6/1988 | Germany | 164/303 |
| 55-36024 | 3/1980 | Japan | 164/113 |
| 1-254364 | 10/1989 | Japan | 164/900 |
| 5-285627 | 11/1993 | Japan | 164/900 |
| 6-234054 | 8/1994 | Japan | 164/113 |

*Primary Examiner*—J. Reed Batten, Jr.

*Attorney, Agent, or Firm*—Sughrue, Mion, Zinn, Macpeak & Seas, PLLC

[57] ABSTRACT

A metallic feed initially in a solid state is fed into a cylinder barrel of an injection molding machine. The metallic feed is melted by applying heat to the metallic feed from outside the cylinder barrel and by heat produced from frictional and shearing forces generated by rotation of a screw housed within the cylinder barrel. The cylinder barrel and screw define at least a feed zone, a compression zone and an accumulating zone. After melting and passing through each of the three zones, the metallic feed is injected into a die, to thereby form a shaped part. The temperature of the metallic feed is controlled to be above the liquidus of the metallic feed during the injecting process.

10 Claims, 4 Drawing Sheets

PROCESS FOR PRODUCING SHAPED PARTS OF METALS

BACKGROUND OF THE INVENTION

1. Field of the Invention

The present invention relates to a process for producing shaped parts of metals, which comprises the steps of melt blending a metallic feed having a melting point which is 700° C. or less directly in an injection molding machine without using other equipment such as a metal furnace and then injecting the molten feed into a mold for producing a shaped metal part.

2. Related art

As is well known, metals are conventionally shaped by various methods such as pressure casting which involves mechanical pressurization and gravity casting which does not involve any deliberate pressurization. Known to be included within the category of "pressure casting" are the hot chamber method, the cold chamber method, the squeeze casting method, etc. The squeeze casting method is employed to cast large shapes such as aluminum automotive wheels, whereas the hot chamber method, the cold chamber method and others are used to manufacture shaped parts of small and medium sizes. Lead alloys having large specific gravities are customarily shaped by gravity casting which makes use of gravitational force.

In addition to these established methods, thixo-molding has recently been proposed as a new casting technique (Japanese Examined patent publication 1-33541, Japanese Examined Patent Publication 2-15620 or the like). When an alloy feed is agitated in this method with a solid phase coexisting with a liquid phase, the formation of treelike crystals, generally called "dendrites", is suppressed, yielding a slurry-like substance in which a solid phase consisting of the fine grains of destroyed dendrites coexists with a liquid phase. When the slurry-like substance characterized by the coexistence of a solid and a liquid phase is solidified within a short period of time, there is provided a product that is soild and uniform. The degree of shrinkage is small in this product upon solidification. Further, only a limited number of shrink holes caused by micro-shrinkage and gap holes caused by gas are found in the product. Hence, it is satisfactory in terms of both mechanical properties and shape-related precision.

The production of shaped alloy parts utilizing the inherent nature of the slurry-like substance involves the use of an injection molding or an extruding machine. The injection molding machine comprises a screw cylinder combination capable of temperature control. When the screw is driven to rotate, the alloy feed is displaced progressively toward the distal end of the cylinder by means of the screw, as it melts at a temperature not below its solidus but not above its liquidus. After the feed has reached the distal end of the cylinder, the temperature of the screw cylinder combination is controlled in such a way that both a solid and a liquid phase will exist. The alloy feed in this state is injected from the distal end of the screw cylinder combination into a mold, where a shaped alloy part is obtained.

The gravity casting method has the advantage that the mold it uses is comparatively inexpensive and capable of yielding a desired cast shape. As a further advantage, the spent casting can be recovered, melted in a melting furnace and recycled by comparatively simple procedures. On the other hand, molten metals will solidify under gravity and, hence, suffer the disadvantage of casting shaped parts of low quality due to the presence of shrinkage voids. Furthermore, the solidification under gravity is inadequate for casting precise shaped parts.

Compared to the gravity casting method, pressure casting (die casting) is capable of achieving to some extent the removal of shrinkage voids from the cast products, which hence feature a certain improvement in quality. In addition, the pressure applied permits metals to be molded in various shapes with a comparatively high precision. Further, the parts shaped by pressure casting can also be recovered and remelted in a melting furnace and, hence, they can be recycled with comparative ease. On the other hand, however, the equipment used in die casting contains many air-containing spaces along runners and air entering the mold during casting is often entrapped in the cast product which, hence, is incapable of assuring adequate mechanical strength. Another problem is the difficulty involved in controlling the melt to be injected in an adequate volume, for example ±5%; hence, the melt cannot be injected into a mold in volumes suitable from the specific parts to be shaped; furthermore, the dimensional and weight precisions that can be achieved are too low to accomplish precise molding. Hence, die casting is no more effective than the aforementioned gravity casting method in producing precision shaped parts such as automotive parts, parts of office automation (OA) equipment, parts of factory automation (FA), parts of business machines, parts of electrically operated tools, and parts of communication equipment.

Like the aforementioned gravity casting method, the pressure casting process requires a separate furnace for melting metals; since the melting furnace dissipates a large amount of heat, the pressure casting process has the added disadvantage of requiring a great amount of energy. Further, as in the case of conventional casting processes, metal feeds must be melted in the furnace and this increases the temperature in the shop to such high levels that the quality of the working environment is degraded. The furnace not only presents a potential burn hazard by melt splashes but also increases the size of the facilities, i.e., of the plant.

Compared to the gravity and pressure casting methods, the thixo-molding process has a recognized merit in that alloy feeds can be held in the solid-liquid state using an injection molding machine and that a melting furnace is not particularly needed for this purpose. As a further advantage, injecting the slurry-like substance into a mold from the injection molding machine enables the production of metal shapes of comparatively high quality. However, the proportion of the solid phase relative to the coexisting liquid phase will change in response to the slightest temperature change, thus making it extremely difficult to create a stable solid-liquid phase. Thus, it is difficult to apply this method to a metal or alloy having a very narrow temperature range for the solid-liquid phase or having the same temperature for the solid-liquid phase. Thus application of this method is very restricted.

Further, the thixotropic fluidity will be readily damaged unless agitation is effected, and although agitation is done by the screw in the case of injection molding, the slurry-like substance metered in the front part of the screw is not agitated at all; this makes it difficult to maintain the thixotropic fluidity of that substance, occasionally leading to the separation of the solid and liquid phases.

When separation of the solid and liquid phase occurs, the liquid phase becomes injected first. On the other hand, if the solid phase is increased, a crack is transmitted between a crystal solidified soon after injection and a matrix, thereby deteriorating mechanical strength.

SUMMARY OF THE INVENTION

The present invention has been accomplished with a view to providing a process for producing shaped parts of metals that are substantially free from the problems or defects of the above-described processes for manufacturing metal shapes. A more specific object of the invention is to provide a process for producing shaped parts of metals, by which process metal shaped parts of aluminum or magnesium or alloys thereof that can be recycled easily, that have high mechanical strength and that feature high dimensional and weight precisions can be manufactured in a favorable working environment with utmost safety and at low cost.

According to an aspect of the present invention, there is provided a method for producing shaped parts of metals comprising the steps of: melting a metallic feed in a solid state by heating it from outside and by a friction and a shearing generated by a rotation of a screw, the metallic feed being accommodated in a cylinder barrel of an injection molding machine which includes at least a feed zone, a compression zone and an accumulating zone; injecting a metallic feed into a die to form the shaped parts, wherein the metallic feed is set at a temperture above the liquidus of the metallic feed while injecting.

According to the present invention, the metallic feed positioned at the accumulating zone is set at a temperature which is not less than the liquidus of the metallic feed.

According to the present invention, the temperature of the metallic feed is not more than 700° C.

According to the present invention, the screw of the injection molding machine is adapted to have a compression ratio of 1.0 to 2.0.

According to the present invention, at least 90% in wt % of the metallic feed is in the form of grains or columns having diameters of no more than 5 mm or lengths of no more than 10 mm or is in the form of shavings or the like.

BRIEF DESCRIPTION OF THE DRAWINGS

FIG. 1(A) is a front view, with part shown in section and FIG. 1(B) a partial enlarged view of the screw portion;

FIG. 4 (B) to an aluminum-copper alloy; FIG. 4 (C) to an aluminum-silicon alloy; and FIG. 4 (D) to a magnesium-aluminum alloy.

DETAILED DESCRIPTION OF THE PREFERRED EMBODIMENTS

Figure 2:
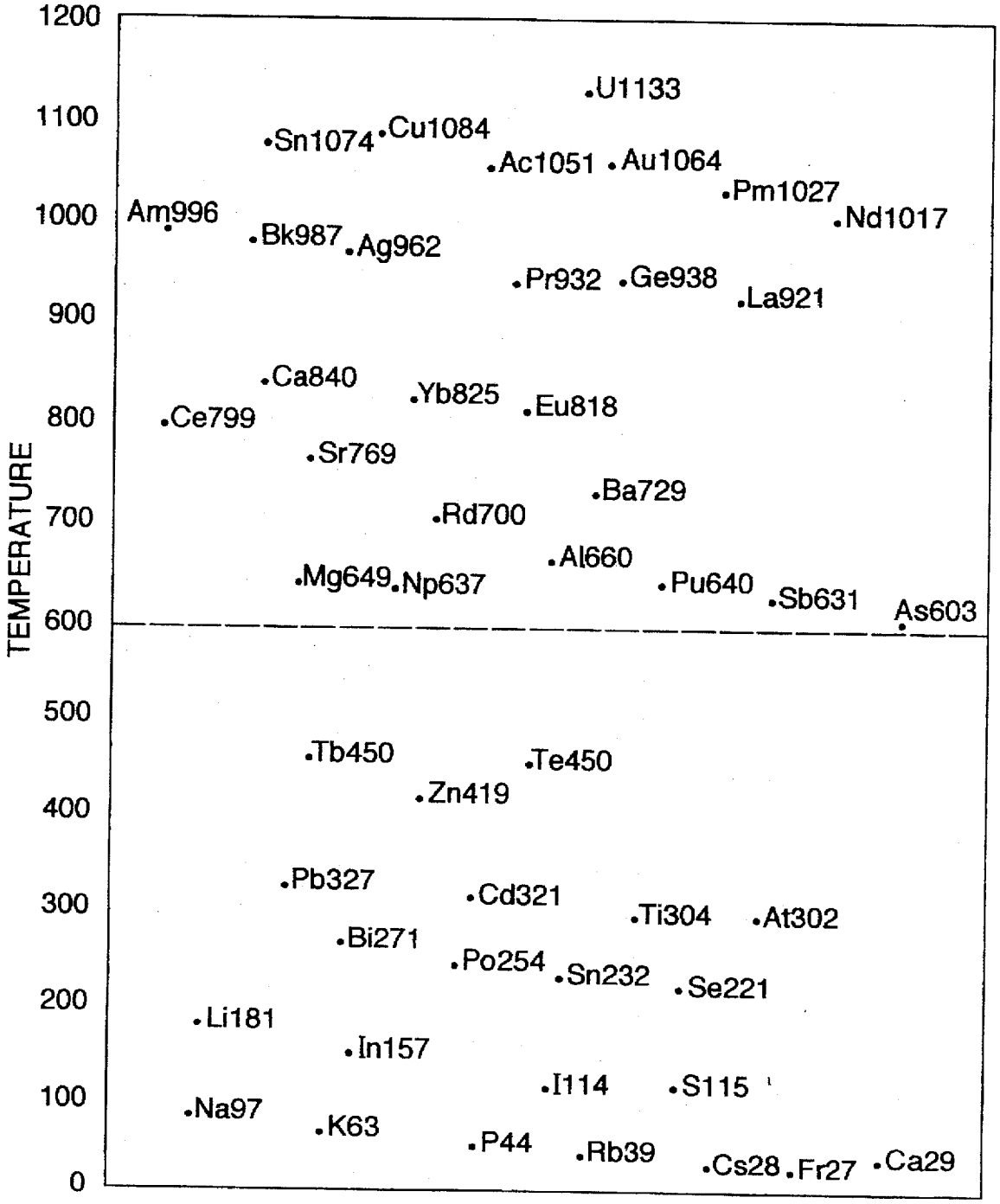
FIG. 2 is a chart plotting the melting points of various metals.

The "metallic feed" as used in the invention is a single metallic or alloying element that has a melting point of 700° C. or less and which is selected from the elements plotted in FIG. 2; alternatively, it is a mixture of two or more of those metallic or alloying elements. Practical examples include the following: aluminum, magnesium, zinc, tin, lead, bismuth, terbium, tellurium, cadmium, thallium, astatine, polonium, selenium, lithium, indium, sodium, potassium, rubidium, cesium, francium and gallium. Aluminum, magnesium, lead, zinc, bismuth and alloys based on these metals are particularly desirable. All of these metallic feeds are metallic elements or alloys that can be melt blended and injection molded by means of injection molding machines, such as an in-line screw type injection machine. The melting point of copper is 1085° C., which is extremely higher than 700° C. However, the melting point of copper alloy for braze is 700° C. or less. Therefore, the present invention is applicable to the copper alloy.

Figure 1A:
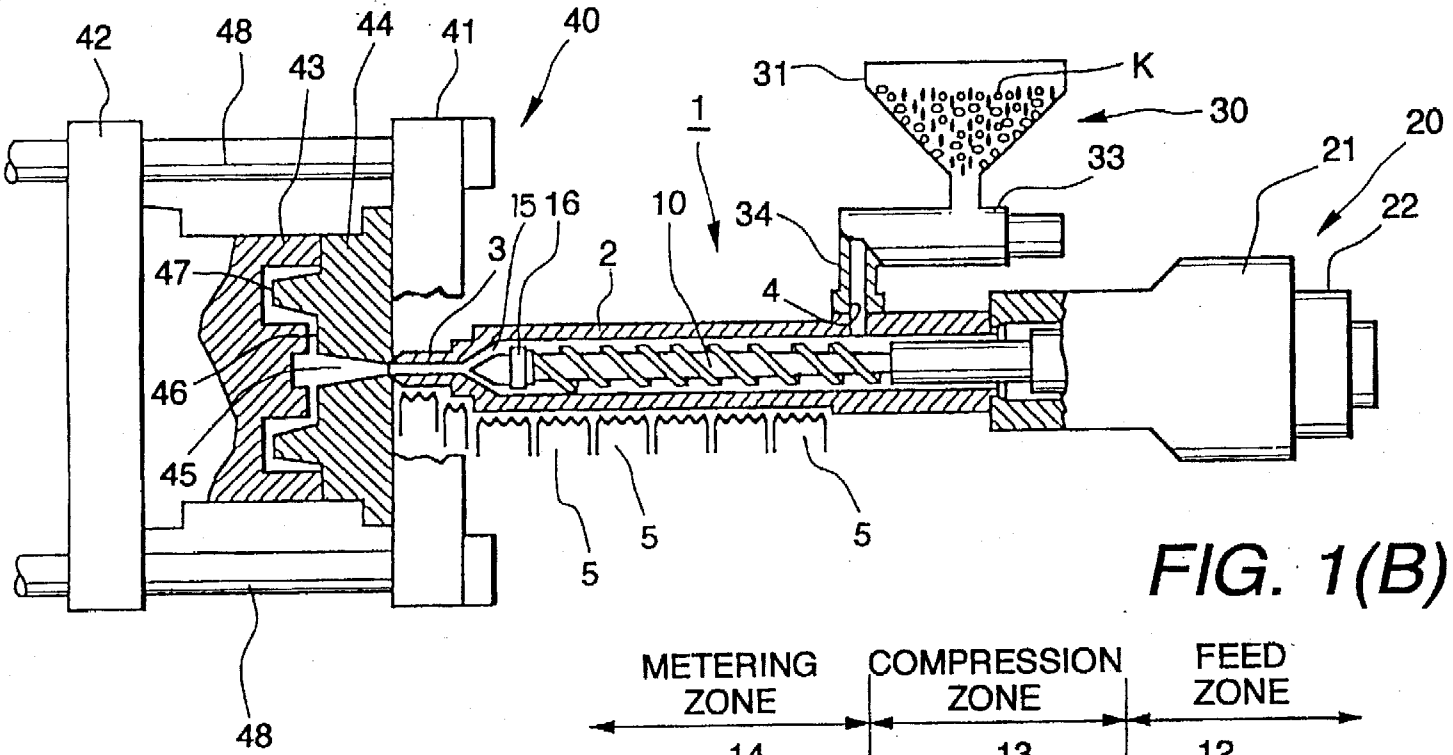
FIGS. 1(A) and 1(B) illustrate examples of the in-line screw type injection machine that may be used in the practice of the invention, where

These metallic feeds can be prepared by various methods. For instance, ingots may be chipped mechanically. Alternatively, shavings which result from mechanical cutting operations may be used. Moreover, the metallic feeds can be prepared by dropping the melting metal onto a cooled material such as water. The metallic feeds prepared by these methods are of relatively small size and are very easily handled, as opposed to metallic powder. Therefore, those metallic feeds will melt easily within the cylinder barrel 2 (see FIG. 1(A) beginning with their advancing end.

If desired, the metallic feeds may be prepared by well-known conventional techniques such as the reduction method and the rotating consumable electrode method.

The grain diameter or size of the feed metals to be applied in the invention is not limited to any particular values as long as they can be supplied into the cylinder barrel and melt-blended therein. However, in consideration of various factors such as the ease with which the metallic feeds are melt-blended within the cylinder .barrel and the cost of preparing them, the preferred size of the metallic feeds is generally 10 mm or less, preferably 5 mm or less. Stated more specifically, if the metallic feeds are in the form of grains or columns, they preferably have grain sizes of 0.5 to 5 mm or less and lengths of 2 to 10 mm or less, which compare with the sizes of plastic pellets. The metallic feed overall preferably contains 90% wt or more of metallic feed particles meeting the above size constraints. If the content of relatively large size metallic feed particles is increased, the rotational friction of the screw is increased. Thus, it is not suitable for practical use. If the content of relatively small size metallic feed particles increased, it is difficult to bit the metallic feed particles in the screw. If the metallic feed particles are in the form of shavings or the like that result from machining, they preferably should have lengths of 2–10 mm or less. Further, it is preferable that metallic feed particles of this type comprise 90% wt or more of the overall feed.

The thusly selected metallic feeds are desirably injected from an in-line screw type injection machine into a mold apparatus. The screw in the injection molding machine comprises generally a feed zone, a compression zone, an accumulating zone, etc. The compression ratio of the screw, namely, the ratio of the capacity of the total space of grooves in the supply zone to that in the accumulating zone, is selected to lie between 1.0 and 2.0.

Even a non-compressing screw, or a screw whose compression ratio is unity, is capable of melting the aforementioned metallic feeds although the melting efficiency is slightly reduced. If the compression ratio of the screw exceeds 2, an excessive torque will be required to collapse the metallic feeds and the resistance to their forward displacement is so much increased that the screw will be "occluded". Experiments have shown that the preferred compression ratio is between 1.2 and 1.8.

A heating apparatus is provided on the periphery of the cylinder barrel of the in-line screw type injection machine. The temperature to be generated by the heating apparatus is subjected to precise and close control. Stated specifically, the heating temperature is set at temperatures exceeding the melting point of the metallic feed of interest (temperatures in excess of the liquidus in the phase diagram of the feed). Experiments have shown that the temperature in the cylinder barrel gives satisfactory results if it is within +50° C., preferably +30° C., higher than the melting point of the metallic feed.

Close to the lower limit of this temperature range, the rotating torque of the screw will increase so much that the motor, drive mechanism and other related equipment will become bulky thereby increasing the operational cost. If the heating temperature exceeds the upper limit of the indicated temperature range, the metallic feeds will melt prematurely and the molten and unmolten portions of the metallic feed can no longer be pumped from the feed zone to the subsequent compression zone.

Compared to plastics, the metal feeds are characterized by good heat conduction, and they will solidify rapidly upon cooling within molds. Therefore, it has been found experimentally that the injection speed is desirably at least 50 cm/s, which is 5 times as fast as in the case of injection molding of plastics. These speeds are applicable to the metals that are plotted in FIG. 2 and which melt at temperatures not higher than 700° C., as well as alloys thereof.

A specific example of the injection molding machine that is suitably used in the practice of the invention is described below. As shown in FIG. 1, the injection molding machine consists of an in-line screw type injection unit 1 and a mold unit 40. The injection unit 1 consists basically of a cylinder barrel 2, a screw 10 that is driven not only to rotate within the cylinder barrel 2 but also to move in the axial direction, a drive unit 20 for driving the screw 10, and a feeder 30 for supplying a metallic feed into the cylinder barrel 2.

The cylinder barrel 2 is in a tubular form, with a nozzle 3 being provided at the distal end for injecting a molten metallic feed. The other end of the barrel 2 is connected to the casing 21 of the drive unit 20. An opening 4 for supplying the metallic feed is made in the side wall of the cylinder barrel 2 in a position that is slightly offset from the middle toward the drive unit 20. Heaters 5 are provided on the periphery of the cylinder barrel 2 in an area extending from the opening 4 to the nozzle 3. Although not shown, a control unit is provided to enable fine temperature control by the heaters 5.

Figure 1B:
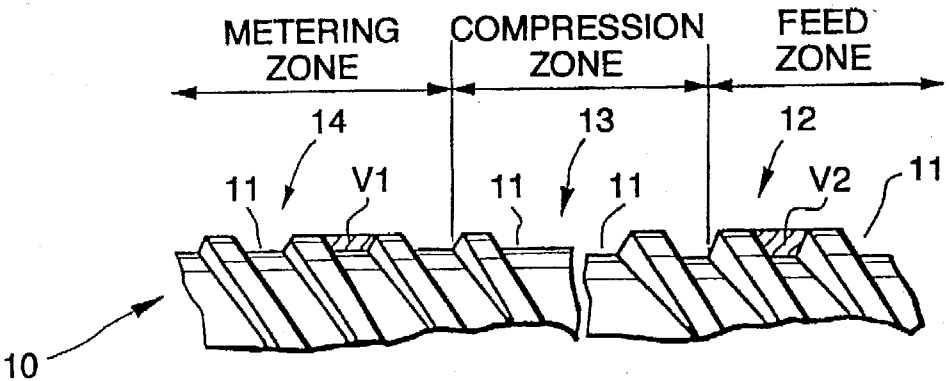

As is clearly shown in FIG. 1(B), the screw 10 consists of a feed zone 12 for forcing the metallic feed into the grooves 11 so that it is fed into an adjacent compression zone 13, the compression zone 13 having progressively shallower grooves 11 to compress the molten metal so that the entrapped air will flow back toward the opening 4, and a metering zone 14 positioned at a distal portion of the screw 10. The screw 10 has a check ring 16 provided at the distal end.

The compression ratio $V_2/V_1$ ($V_2$: the capacity of the spaces within the grooves in the feed zone 12; $V_1$: the capacity of the spaces within the grooves in the metering zone 14), is selected at a value between 1.0 and 2.0.

The drive unit 20 is furnished with an electric motor or a hydraulic motor 22, which will drive the screw 10 to rotate at a predetermined speed. The casing 21 of the drive unit 20 contains an injection ram and the screw 10 is driven axially at a comparatively high speed. The drive speeds of the motor and the ram are also controlled by a control unit.

The feed unit 30 comprises a funnel-shaped hopper 31, a screw feeder 33 provided beneath the hopper 31, and a supply channel 34. The screw in the screw feeder 33 is driven by a control unit at a controlled speed. The lower end of the supply channel 34 is connected to the opening 4 in the cylinder barrel 2.

The mold unit 40 is furnished with a fixed platen 41 and a movable platen 42. The platens 41 and 42 have, respectively, a fixed mold 44 and a movable mold 43 mounted thereon. The fixed mold 44 has a sprue 45 formed in an axial direction and has a runner 46 formed along a parting line between the fixed mold 44 and the movable mold 43. The movable mold 43 is provided with cavities 47 for producing a shaped part.

The movable platen 42 is driven in either a mold opening or closing direction with respect to the fixed platen 41 but the associated drive mechanism is not shown in FIG. 1. The fixed platen 41 is connected to the movable platen 42 by means of tie-bars 48. The movable mold 43 is clamped with respect to the fixed mold 44 by means of a toggle mechanism, which is not shown in FIG. 1.

Discussed below is a case in which the above-described injection molding machine is used to manufacture metal shaped parts from metallic feeds. The process starts with providing the metallic feed K having a particle size of no more than 10 mm and placing it within the hopper 31.

At the same time, the temperatures to be created by the heaters 5 are so set by the control unit that they are higher than a melting point corresponding to the liquidus temperature in the phase diagram of the metallic feed K.

The motor 22 is switched on to drive the screw 10 while driving the screw feeder 33 at a predetermined speed. This causes the metallic feed K in the hopper 31 to be supplied to the feed zone 12 within the cylinder barrel 2 via the supply channel 34 and through the opening 4 in a given amount that is determined by the rotating speed of the screw feeder 33. The supplied metallic feed K is mixed by the rotating screw 10. At the same time, the metallic feed K is warmed by frictional heat and by the heat applied from the heaters 5 as it is forwarded to the adjacent compression zone 13, where it is melted. With the grooves 11 in the compression zone 13 of the screw being progressively shallower, the molten metal is compressed and the entrapped air flows back toward the opening 4. On the other hand, the melt blended metal is forwarded to the metering zone 14 and accumulating zone 15 positioned on a distal end of the cylinder barrel 2 as the screw 10 retracts to have a given amount of the metal stored in the accumulating zone 15.

The movable mold 43 is clamped with respect to the fixed mold 44 and the nozzle 3 on the cylinder barrel 2 is brought to touch the sprue 45. Then, the injection ram is pushed to drive the screw 10, thereby injecting the stored, completely molten metal into the cavities 47. Since the molten metal will solidify quickly, the pushing speed of the injection ram is controlled in such a way that the melt is injected at a speed not slower than 50 cm/s. After the injection, the metal is cooled to solidify, and once this is done, the mold unit 40 is opened to recover the injected metal shape.

In the meantime, the steps of melt blending, compression and storage of another shot of the metallic feed are performed in preparation for the next injection cycle. Thereafter, the metallic feed is injected in the same manner as described above. At this time, the metal solidified at a tipped portion of the nozzle 3 while appearing at a prior injection operation.

The above procedures are repeated to produce injected metal shapes using the metallic feed K already described above. Among the metal shapes that can be produced are automotive parts, parts of office automation (OA) equipment, parts of factory automation (FA) equipment, parts of business machines, parts of electric appliances, parts of electrically operated tools and parts of communication equipment.

EXAMPLE 1

Preparation of metallic feed

A metallic feed was prepared by cutting a lead-tin binary alloy ingot. The metallic feed thus prepared was subjected to grain size distribution and maximum size measurements. The results are shown in Table 1 below.

Table 1. Grain Size Distribution (wt %)

| Size (length in mm) | Proportion |
|---|---|
| <5 | 65.0 |
| 5–10 | 31.0 |
| 10–15 | 3.0 |
| >15 | 1.0 |

The metallic feed particles had a maximum length of 17 mm.

(Injection molding)

The metallic feed described above was processed into terminals on batteries for motorcycles by being injected into a mold from a specially designed in-line screw type injection machine having a compression ratio of 1.5. During the injection, the heaters 5 around the cylinder barrel 2 were set for a temperature of 327° C. that was +25° C. higher than the liquidus of the alloy which contained 92 wt % Pb (see FIG. 3). The heater 5 for the nozzle 3 was set for a lower temperature of 295° C. The injection speed was 60 cm/s.

Results

The terminals on batteries for motorcycles as produced under the conditions set forth above were measured for dimensional and weight precisions. The mold cavities had acute angled portions but the molten metal could successfully be injected into these acute angled portions, producing the metal shaped part having satisfactory dimensional and weight precisions.

EXAMPLE 2

Preparation of metallic feed

A metallic feed was prepared by cutting an aluminum-magnesium binary alloy ingot with 10% magnesium. The metallic feed thus prepared was subjected to grain size distribution and size measurements. The results are shown in Table 2 below.

TABLE 2

| Grain Size Distribution (wt %) | |
|---|---|
| Size (length in mm) | Proportion |
| <5 | 72.0 |
| 5–10 | 15.0 |
| 10–15 | 10.5 |
| >15 | 2.5 |

The metallic feed particles had a maximum length of 18 mm.

(Injection molding)

Figure 4A:
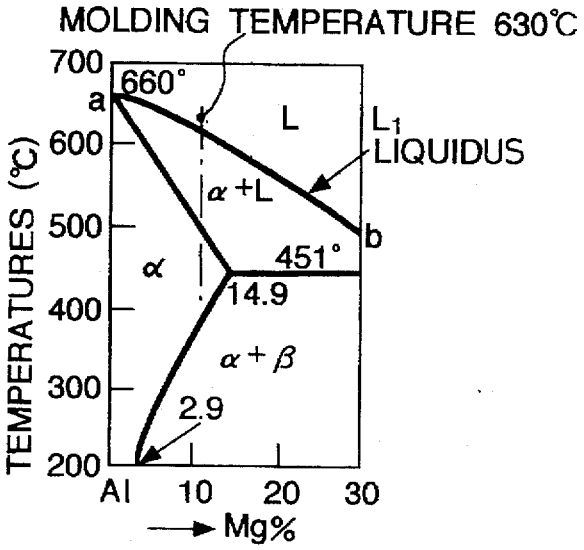
FIGS. 4 (A) to 4 (D) show four equilibrium phase diagrams, FIG. 4 (A) referring to an aluminum-magnesium alloy.
Figure 4B:
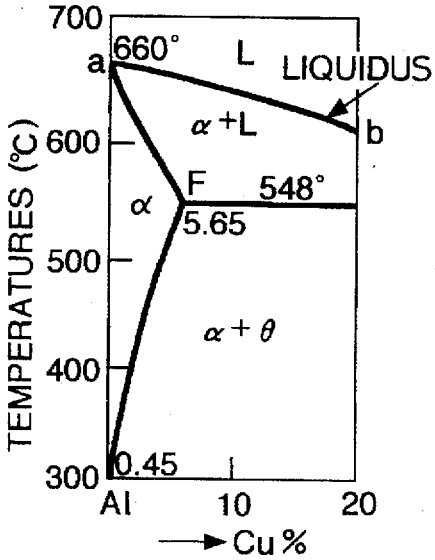
Figure 4C:
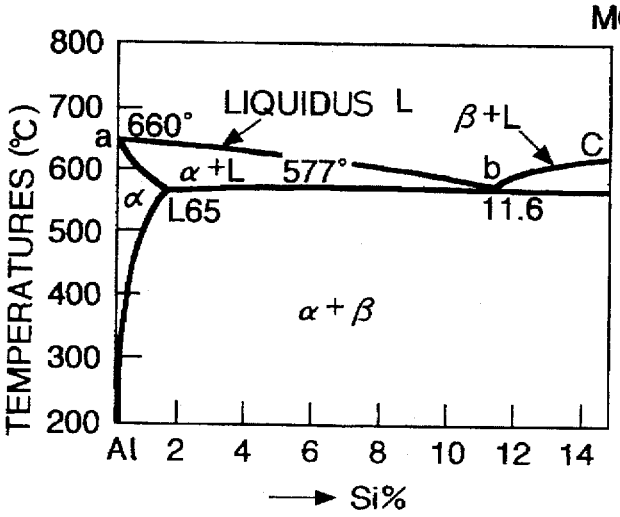

The metallic feed described above was processed into a flat shape by being injected into a mold from a specially designed in-line screw type injection machine having a compression ratio of 1.5 (for its basic structural features, see the description above). During the injection, the heaters 5 placed around the cylinder barrel in the areas corresponding to the compression zone 13 and the metering zone 14 were set for a temperature of 630° C., above the liquidus of the aluminum-magnesium alloy with 10% magnesium which is shown in FIG. 4A. The heaters 5 for the feed zone 12 and the nozzle were set for a lower temperature of 600° C. The injection speed was set at 60 cm/s.

Results

The flat shape as produced under the conditions set forth above was measured for dimensional and weight precisions. The mold cavities had acute angled portions but the molten metal could successfully be injected into these acute angled portions, producing the metal shaped part having satisfactory dimensional and weight precisions.

EXAMPLE 3

Preparation of metallic feed

A metallic feed was prepared by cutting a magnesium-aluminum binary alloy ingot with 9% aluminum. The metallic feed thus prepared was subjected to grain size distribution and size measurements. The results are shown in Table 3 below.

TABLE 3

| Grain Size Distribution (wt %) | |
|---|---|
| Size (length in mm) | Proportion |
| <5 | 66.0 |
| 5–10 | 25.5 |
| 10–15 | 5.0 |
| >15 | 3.5 |

The metallic feed particles had a maximum length of 18 mm.

(Injection molding)

Figure 4D:
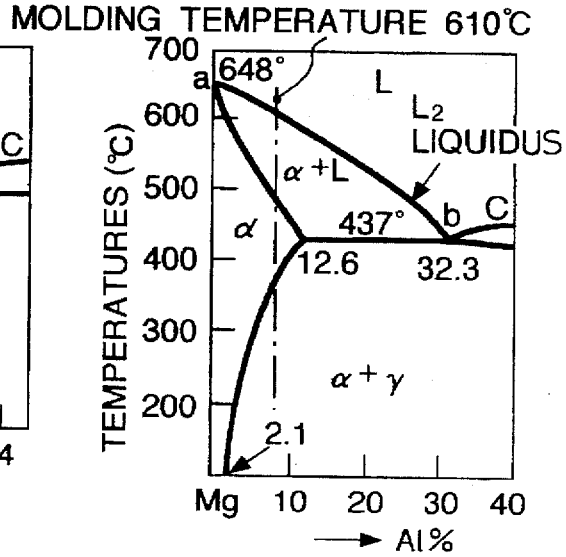

The metallic feed described above was processed into a box shape by being injected into a mold from an in-line screw type injection machine of the same design as used in Example 1. During the injection, the heaters 5 placed around the cylinder barrel in the areas corresponding to the compression zone 13 and the metering zone 14 were set for a temperature of 610° C., above the liquidus of the magnesium-aluminum alloy with 9% aluminum which is shown in FIG. 4D. The heaters 5 for the feed zone 12 and the nozzle were set for a lower temperature of 560° C. The injection speed was set at 60 cm/s.

(Results)

The box shape as produced under the conditions set forth above was measured for dimensional and weight precisions. The mold cavities had acute angled portions but the molten metal could successfully be injected into these acute angled portions, producing the metal shaped part having satisfactory dimensional and weight precisions.

Case Example:

A specific case is described below as it relates to the molding of a core for use in the lost-core molding of a bismuth-tin alloy.

Figure 3:
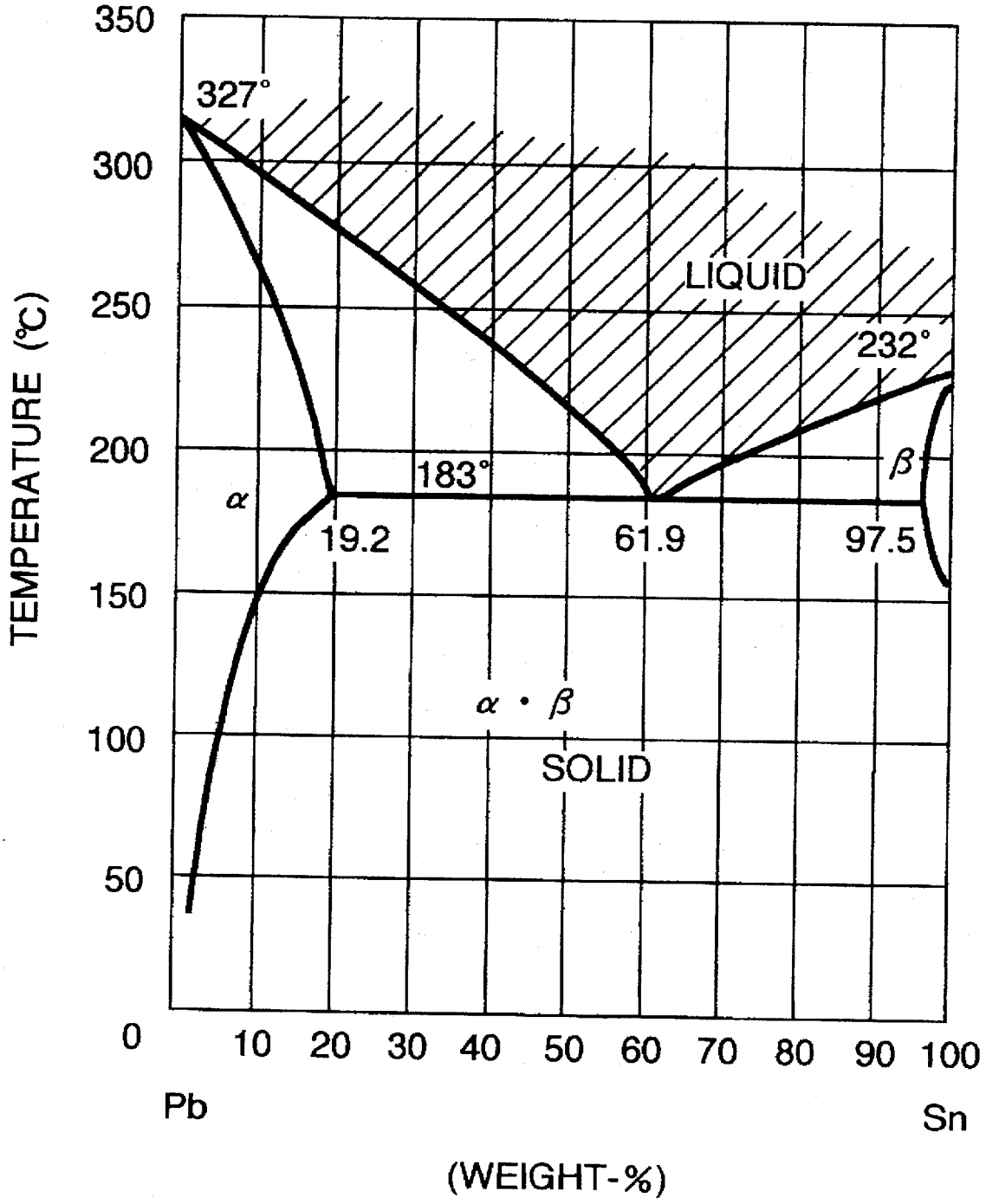
FIG. 3 is a phase diagram for a lead-tin alloy.

Since the bismuth-tin alloy has a melting point of 60° C., the heaters 5 around the cylinder barrel 2 were set for a temperature of 168° C. which was +40° C. higher than the liquidus in the phase diagram of that alloy (not shown in FIG. 3). The heater 5 at the nozzle 3 was set for a temperature of 130° C. The injection speed was set at 60 cm/s on the basis of the results of other experiments. The molten bismuth-tin alloy was injected into a mold from an in-line screw type injection machine to yield shaped cores having satisfactory dimensional and weight precisions.

The cores were inserted into plastics shaping molds and molding was done to yield glass-filled plastic (nylon) shapes surrounding the cores.

Subsequently, the shaped plastics were heated at a temperature of +5° C. higher than the melting point of the bismuth-tin alloy, whereupon the cores being made of the bismuth-tin alloy were melted and flowed out of holes made in the respective plastic shapes. Thus, hollow, glass-filled seamless nylon shapes were produced.

While an example of the case for molding terminals on batteries for motorcycles from a lead-tin binary alloy, as well as a specific example of molding cores for use in the lost-core molding of a bismuth-tin alloy have been described above, it will be apparent to one skilled in the art that precise shaped metal parts such as automotive parts and parts of office automation (OA) equipment can also be injection molded from other metallic feeds having melting points of 700° C. or below.

As mentioned in the "Related Art" section above, the thixo-molding process parallels with the method of the invention in that a molten metal is injected from an injection molding machine into a mold, thereby producing a shaped part. Hence, tests were conducted to compare the inventive method with the thixo-molding process, as well as with the conventional die casting and gravity casting methods by molding test pieces A, B and C in the form of a round bar using a lead-antimony alloy as the metallic feed. The results are shown in Tables 4 and 5.

TABLE 4

| Method | Molding temperature | Cycle time | Stability of melt temperature | Stability in metering | Mechanical strength | Size of microstructure |
|---|---|---|---|---|---|---|
| Test piece A | +30–+50 | Δ | ○ | Δ | ○ | Δ |
| Test piece B | +15–+30 | Δ | ◎ | ◎ | ◎ | ◎ |
| Test piece C | 0–+10 | Δ | ◎ | ◎ | ◎ | ◎ |
| Thixo-molding method 1 | −15–0 | ○ | Δ | Δ | ○ | ○ |
| Thixo-molding method 2 | −30—10 | ○ | X | X | X | X |
| Die casting method | | ◎ | Δ | X | ○ | Δ |
| Gravity casting method | | ◎ | Δ | X | X | X |

TABLE 5

| Method | Molding temperature | Transferability | Surface gloss | Void volume | Mold releasability | Burrs | Yield |
|---|---|---|---|---|---|---|---|
| Test piece A | +30–+50 | ◎ | ◎ | ○ | ○ | Δ | ○ |
| Test piece B | +15–+30 | ◎ | ◎ | ◎ | ◎ | ○ | ◎ |
| Test piece C | 0–+10 | ◎ | ○ | ◎ | ◎ | ○ | ◎ |
| Thixo-molding method 1 | −15–0 | Δ | Δ | ○ | ◎ | ◎ | ○ |
| Thixo-molding method 2 | −30—10 | X | X | X | Δ | ◎ | Δ |
| Die casting method | | ○ | Δ | Δ | X | X | X |
| Gravity casting method | | X | X | X | X | X | X |

The "molding temperature" as appearing in Tables 4 and 5 is referenced to the melting temperature and higher temperatures are represented by the plus sign "+" and lower temperatures by the minus sign "–". The "mold releasability" was evaluated in terms of the amount of a release agent used; the "yield" was evaluated in terms of the volume and intensity of overflows.

The criteria for evaluation as used in Tables 4 and 5 have the following meanings: ◎, excellent; ○, good; Δ, fair; x, poor.

Obviously test pieces A, B and C gave superior results in all aspect (as indicated by the large number of double circles "◎") over the other molding methods tested, particularly in comparison with the thixo-molding process which parallels with the examples of the invention in that it involves an injection molding technique.

In the same manner, tests were conducted to compare the inventive method with the thixo-molding process and the conventional method by molding test pieces D, E and F in the form of a round bar using a binary alloy with 91% magnesium as a metallic feed. The results are shown in Tables 6 and 7 below.

TABLE 6

| Method | Molding temperature | Cycle time | Stability of melt temperature | Stability in metering | Mechanical strength | Size of microstructure |
|---|---|---|---|---|---|---|
| Test piece D | +30–+50 | Δ | ○ | ○ | Δ | Δ |
| Test piece E | +15–+30 | Δ | ◎ | ◎ | ◎ | ◎ |
| Test piece F | 0–+10 | Δ | ◎ | ○ | ○ | ○ |
| Thixo-molding method 1 | −15–0 | ○ | Δ | Δ | ◎ | ○ |
| Thixo-molding method 2 | −30—10 | ○ | X | X | X | X |

TABLE 6-continued

| Method | Molding temperature | Cycle time | Stability of melt temperature | Stability in metering | Mechanical strength | Size of microstructure |
|---|---|---|---|---|---|---|
| Die casting method | | ⊙ | Δ | X | ○ | Δ |

TABLE 7

| Method | Molding temperature | Transferability | Surface gloss | Void volume | Mold releasability | Burrs | Yield |
|---|---|---|---|---|---|---|---|
| Test piece D | +30–+50 | ⊙ | ⊙ | ○ | Δ | Δ | Δ |
| Test piece E | +15–+30 | ⊙ | ⊙ | ⊙ | ○ | ○ | ⊙ |
| Test piece F | 0–+10 | ○ | ○ | ○ | ⊙ | ⊙ | ⊙ |
| Thixomolding method 1 | −15–0 | Δ | Δ | Δ | ⊙ | ⊙ | ○ |
| Thixomolding method 2 | −30—10 | X | X | X | Δ | ⊙ | ○ |
| Die casting method | | ⊙ | ○ | ○ | X | X | X |

The "molding temperature" as appearing in Tables 6 and 7 is referenced to the melting temperature and higher temperatures are represented by the plus sign "+" and lower temperatures by the minus sign "−". The molding temperature corresponds to the one that is set for the compression and accumulating zones and the temperature for the feed zone and the nozzle is set at a slightly lower temperature.

The criteria for evaluation as used in Tables 6 and 7 have the following meanings: ⊙, excellent; ○, good; Δ, fair; x, poor. As is clear from Tables 6 and 7, the process of the invention gave superior results in all aspects over the other molding methods tested.

As described on the foregoing pages, the present invention provides a method for producing shaped parts of metals comprising the steps of: melting a metallic feed in a solid state by heating it from outside and by a friction and a shearing generated by a rotation of a screw, the metallic feed being accommodated in a cylinder barrel of an injection molding machine which includes at least a feed zone, a compression zone and an accumulating zone; injecting the metallic feed into a die to form the shaped parts, wherein the metallic feed is set at a temperature above the liquidus of the metallic feed while injecting.

Further, the metallic feed is injected to the die by the use of an injection molding machine. This enables high-pressure filling, yielding metal shapes that are not only satisfactory in dimensional and weight precisions but also high in mechanical strength.

Further, the metallic feeds can be melted directly within the cylinder barrel of an injection molding machine. Hence, the invention eliminates the need for using a melting furnace, which causes great energy loss. Also, according to the invention, metal shaped parts can be produced with high energy efficiency in a highly safe manner without potential burn or other hazards and, in addition, in a clean environment. The elimination of a melting furnace offers the added advantage of providing ease in implementing a fully automated production system.

Still further, the screw of the in-line screw type injection machine is adapted to have a compression ratio of 1.1 to 2.0 and the use of this screw enables the metallic feed to be melted and advanced in an efficient manner.

Still further, a metallic feed includes at least 90% in wt % of metallic feed particles that are in the form of grains or columns having diameters of no more than 5 mm or lengths of no more than 10 mm or in the form of shavings or the like that result from machining and which have sizes of no more than 10 mm. Therefore, the metallic feed is well bitten at the screw, has a suitable grain size to avoid oxidation and does not melt in the cylinder barrel at an undesired speed such as too fast and or too slow.

What is claimed is:

1. A method for producing a shaped metal part, comprising the steps of:

feeding a metallic feed in a solid state into a cylinder barrel of an injection molding machine, wherein the cylinder barrel includes at least a feed zone, a compression zone and an accumulating zone, and houses a screw rotatably mounted within the cylinder barrel;

advancing the metallic feed from the feed zone through the compression zone to the accumulating zone by rotating the screw;

melting the metallic feed by applying heat to the metallic feed from outside the cylinder barrel and by heat produced from frictional and shearing forces generated as a result of rotation of the screw; and injecting the metallic feed from the accumulating zone into a die to form the shaped metal part, while controlling the temperature of the metallic feed to be above the liquidus of the metallic feed during said injecting step, wherein the temperature is at least 15° C. higher than the liquidus of the metallic feed and no greater than 50° C. higher than the liquidus of the metallic feed.

2. A method for producing a shaped metal part as claimed in claim 1, wherein the temperature of the metallic feed, when positioned at the accumulating zone, is controlled to be not less than the liquidus of the metallic feed.

3. A method for producing a shaped metal part as claimed in claim 1, wherein the liquidus of the metallic feed is not more than 700° C.

4. A method for producing a shaped metal part as claimed in claim 1, wherein the screw of the injection molding machine is adapted to have a compression ratio of 1.0 to 2.0 between the feed zone and the accumulating zone.

5. A method for producing a shaped metal part as claimed in claim 1, wherein at least 90% in wt % of the metallic feed is composed of particles in the form of grains or columns having diameters of no more than 5 mm or lengths of no more than 10 mm or in the form of shavings.

6. A method for producing a shaped metal part as claimed in claim 1, wherein the screw of the injection molding machine is adapted to provide a compression ratio between 1.2 and 1.8.

7. A method for producing a shaped metal part as claimed in claim 1, wherein the temperature is at least 15° C. higher than the liquidus of the metallic feed and no greater than 30° C. higher than the liquidus of the metallic feed.

8. A method for producing a shaped metal part as claimed in claim 1, wherein the temperature is at least 30° C. higher than the liquidus of the metallic feed and no greater than 50° C. higher than the liquidus of the metallic feed.

9. A method for producing a shaped metal part as claimed in claim 1, wherein, in said injecting step, the metallic feed is injected at an injection speed of at least 50 cm/s.

10. A method for producing a shaped metal part as claimed in claim 1, wherein, in the compression zone, the cylinder barrel and the screw cooperate to define progressively shallower grooves in a direction of the accumulating zone, such that the rotation of the screw forces the metallic feed through the compression zone towards the accumulating zone and forces air entrapped in the metallic feed back towards the feed zone.

* * * * *